US011981867B2

(12) United States Patent
Zhang et al.

(10) Patent No.: US 11,981,867 B2
(45) Date of Patent: May 14, 2024

(54) LOW TEMPERATURE PYROLYSIS METHOD OF CAKING MIDDLING COAL

(71) Applicant: Yan'an University, Yan'an (CN)

(72) Inventors: Zhuangzhuang Zhang, Yan'an (CN); Feng Fu, Yan'an (CN); Zhiping Mi, Yan'an (CN); Yanzhong Zhen, Yan'an (CN); Jie Gu, Yan'an (CN); Xiaoxia Yang, Yan'an (CN); Le Wang, Yan'an (CN); Xiaoli Qiu, Yan'an (CN)

(73) Assignee: Yan'an University, Yan'an (CN)

( * ) Notice: Subject to any disclaimer, the term of this patent is extended or adjusted under 35 U.S.C. 154(b) by 0 days.

(21) Appl. No.: 18/197,871

(22) Filed: May 16, 2023

(65) Prior Publication Data

US 2024/0093095 A1 Mar. 21, 2024

(30) Foreign Application Priority Data

May 16, 2022 (CN) ..... 202210529166.7

(51) Int. Cl.

| | |
|---|---|
| ***C10B 53/04*** | (2006.01) |
| ***C10B 49/06*** | (2006.01) |
| ***C10B 57/10*** | (2006.01) |
| ***C10B 57/14*** | (2006.01) |

(52) U.S. Cl.

CPC ..... *C10B 53/04* (2013.01); *C10B 49/06* (2013.01); *C10B 57/10* (2013.01); *C10B 57/14* (2013.01)

(58) Field of Classification Search

CPC ... C10B 53/04; C10B 49/02–06; C10B 57/10; C10B 57/14

See application file for complete search history.

(56) References Cited

FOREIGN PATENT DOCUMENTS

| | | | | |
|---|---|---|---|---|
| CN | 107400526 | * | 11/2017 | ..... C10K 1/00 |
| CN | 206955935 U | | 2/2018 | |
| CN | 108531201 | * | 9/2018 | ..... C10B 53/04 |
| CN | 112625720 A | | 4/2021 | |

OTHER PUBLICATIONS

English machine translation of CN 206955935.*
English machine translation of CN 112625720.*
English machine translation of CN 108531201.*
English machine translation of CN 107400526.*
He, Zhipeng; Research Progress of Caking Property Destruction and Pyrolysis of Low-Rank Caking Coal; China Coal; vol. 47, No. 1, Jan. 2021.

* cited by examiner

*Primary Examiner* — Renee Robinson
(74) *Attorney, Agent, or Firm* — Kirk A. Wilson; Joseph T. Guy; Patent Filing Specialist Inc.

(57) ABSTRACT

The present disclosure relates to the technical field of pyrolysis and improvement of caking middling coals, in particular to a low temperature pyrolysis method of a caking middling coal. The present disclosure provides a low temperature pyrolysis method of a caking middling coal, including the following steps: conveying the caking middling coal into a pyrolysis reactor through a top of the pyrolysis reactor; dividing a reaction chamber of the pyrolysis reactor into a drying section, a softening section, a melting and depolymerization section, a solidification section, and a cooling section by means of multi-channel gas distribution; and conducting zoned temperature control-based pyrolysis to obtain semi-coke at a bottom of the reactor as well as tar and coal gas at the top of the reactor. The pyrolysis method can well avoid caking and swelling of the caking middling coal during pyrolysis.

2 Claims, 1 Drawing Sheet

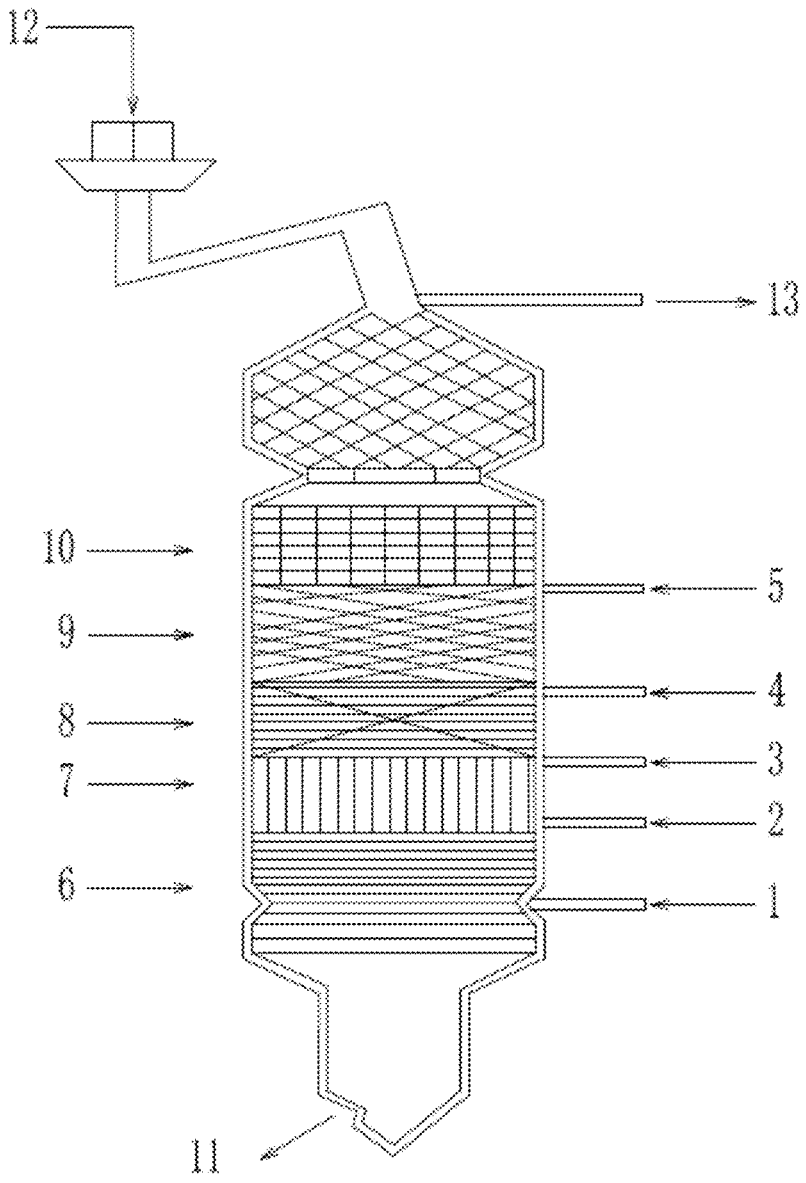
12
13
10
9
8
7
6
5
4
3
2
1
11

LOW TEMPERATURE PYROLYSIS METHOD OF CAKING MIDDLING COAL

CROSS REFERENCE TO RELATED APPLICATION

This patent application claims the benefit and priority of Chinese Patent Application No. 202210529166.7, filed with the China National Intellectual Property Administration on May 16, 2022, the disclosure of which is incorporated by reference herein in its entirety as part of the present application.

TECHNICAL FIELD

The present disclosure relates to the technical field of pyrolysis and improvement of caking middling coals, in particular to a low temperature pyrolysis method of a caking middling coal.

BACKGROUND

As an intermediate product between clean coal and gangue during the coal washing, caking middling coal has strong cohesiveness and high ash content. The caking middling coal is currently mainly used as a low-quality fuel for direct combustion in boilers.

Generally, caking middling coal has a volatile content as high as 25% to 40% after washing, and can be used as a pyrolysis-improving raw material to produce semi-coke, tar, and coal gas products through the pyrolysis. However, this type of coal may form a large amount of colloids in which gas, liquid, and solid phases coexist during the pyrolysis, and can further solidify and swell when being heated. The traditional fixed pyrolysis improving process may cause coal particles to stick to each other or stick to the furnace wall, resulting in semi-coke product sticking and clumping, materials stagnating and hanging in the furnace, difficulty in unloading and separation, and peak ash content of semi-coke. These can seriously affect a product quality and operability of the pyrolysis reactor. At present, some progress has been made in reducing the cohesiveness of pyrolysis raw materials through pre-oxidation, solvent extraction and other methods. However, these methods have long process flow, high processing cost, and poor practicability, and are not popularized and applied yet. Therefore, it is of great significance to effectively realize the pyrolysis improving of caking middling coal, thus avoiding caking and swelling of coal materials, as well as improving operability of the pyrolysis reactor.

SUMMARY

An objective of the present disclosure is to provide a low temperature pyrolysis method of a caking middling coal. The pyrolysis method can avoid caking and swelling of the caking middling coal during pyrolysis.

To achieve the above objective, the present disclosure provides the following technical solutions:

The present disclosure provides a low temperature pyrolysis method of a caking middling coal, including the following steps:

conveying the caking middling coal into a pyrolysis reactor through a top of the pyrolysis reactor; dividing a reaction chamber of the pyrolysis reactor into a drying section, a softening section, a melting and depolymerization section, a solidification section, and a cooling section by means of multi-channel gas distribution; and conducting zoned temperature control-based pyrolysis to obtain semi-coke at a bottom of the reactor as well as tar and coal gas at the top of the reactor.

Preferably, the caking middling coal has a caking index of greater than or equal to 40 and an ash content of greater than or equal to 30 wt %.

Preferably, the method further includes mixing the caking middling coal with a non-caking coal before the caking middling coal is conveyed into the pyrolysis reactor; where the non-caking coal has a caking index of less than or equal to 10 and an ash content of less than or equal to 15 wt %.

Preferably, the caking middling coal and the non-caking coal are at a mass ratio of (5-9):(1-5).

Preferably, the caking middling coal and the non-caking coal have a particle size of independently 10 mm to 90 mm.

Preferably, the multi-channel gas distribution includes: providing a first circulating carrier gas channel, a second circulating carrier gas channel, a third circulating carrier gas channel, a fourth circulating carrier gas channel, and a fifth circulating carrier gas channel in sequence from bottom to top on a side wall of the pyrolysis reactor; and introducing a circulating carrier gas into the pyrolysis reactor through the first circulating carrier gas channel, the second circulating carrier gas channel, the third circulating carrier gas channel, the fourth circulating carrier gas channel, and the fifth circulating carrier gas channel separately.

Preferably, the circulating carrier gas includes a waste gas produced by the zoned temperature control-based pyrolysis and a flue gas produced by mixed combustion of air.

Preferably, the circulating carrier gas has a carrier gas flow rate of 1,200 $m^3$/h, 200 $m^3$/h to 250 $m^3$/h, 300 $m^3$/h to 500 $m^3$/h, 200 $m^3$/h to 250 $m^3$/h, and 50 $m^3$/h to 100 $m^3$/h in the first circulating carrier gas channel, the second circulating carrier gas channel, the third circulating carrier gas channel, the fourth circulating carrier gas channel, and the fifth circulating carrier gas channel, respectively.

Preferably, the drying section has a temperature of less than 180° C.; the softening section has a temperature of 150° C. to 395° C.; the melting and depolymerization section has a temperature of 350° C. to 500° C.; the solidification section has a temperature of 500° C. to 900° C.; and the cooling section has a temperature of less than 80° C.

The present disclosure further provides a pyrolysis reactor, including a first circulating carrier gas channel, a second circulating carrier gas channel, a third circulating carrier gas channel, a fourth circulating carrier gas channel, and a fifth circulating carrier gas channel that are arranged in sequence from bottom to top on a side wall of the pyrolysis reactor.

The present disclosure provides a low temperature pyrolysis method of a caking middling coal, including the following steps: conveying the caking middling coal into a pyrolysis reactor through a top of the pyrolysis reactor; dividing a reaction chamber of the pyrolysis reactor into a drying section, a softening section, a melting and depolymerization section, a solidification section, and a cooling section by means of multi-channel gas distribution; and conducting zoned temperature control-based pyrolysis to obtain semi-coke at a bottom of the reactor as well as tar and coal gas at the top of the reactor. In the present disclosure, a residence time of colloids in the pyrolysis reactor can be well controlled through multi-channel gas distribution, and the colloids produced by caking middling coal pyrolysis are promoted to be better carried out by a circulating carrier gas. Meanwhile, the multi-channel gas distribution realizes precise zoned temperature control of the reactor, where the drying section realizes the recycling of dry water, the softening section is used for softening coal, the melting and depolymerization section can realize rapid pyrolysis of coal, and the solidification section is used for rapid solidification of the semi-coke to form high-strength semi-coke. The caking middling coal can generate a large amount of colloids in the softening section and the melting and depolymerization section, accompanied by melting and caking of the colloids. The multi-channel gas distribution can specifically adjust the circulating carrier gas in the softening section and the melting and depolymerization section, so as to reduce a time that the coal materials are in a plastic state, and further reduce secondary reactions such as cross-linking and polycondensation between the materials. In this way, a caking tendency of semi-coke products is effectively reduced, and the smooth discharge of the semi-coke is realized, thereby avoiding the caking and clogging of semi-coke and improving the operability of pyrolysis.

BRIEF DESCRIPTION OF THE DRAWINGS

FIGURE shows a structural schematic diagram illustrating the pyrolysis reactor of the present disclosure.

Reference numerals: 1—first circulating carrier gas channel, 2—second circulating carrier gas channel, 3—third circulating carrier gas channel, 4—fourth circulating carrier gas channel, 5—fifth circulating carrier gas channel, 6—cooling section, 7—solidification section, 8—melting and depolymerization section, 9—softening section, 10—drying section, 11—semi-coke outlet, 12—material inlet, 13—coal gas and tar outlet.

DETAILED DESCRIPTION OF THE EMBODIMENTS

The present disclosure provides a low temperature pyrolysis method of a caking middling coal, including the following steps:

conveying the caking middling coal into a pyrolysis reactor through a top of the pyrolysis reactor; dividing a reaction chamber of the pyrolysis reactor into a drying section, a softening section, a melting and depolymerization section, a solidification section, and a cooling section by means of multi-channel gas distribution; and conducting zoned temperature control-based pyrolysis to obtain semi-coke at a bottom of the reactor as well as tar and coal gas at the top of the reactor.

In the present disclosure, unless otherwise specified, all raw materials for preparation are commercially available products well known to those skilled in the art.

In the present disclosure, the caking middling coal has a caking index of preferably greater than or equal to 40 and an ash content of preferably greater than or equal to 30 wt %.

In the present disclosure, the method further includes preferably mixing the caking middling coal with a non-caking coal before the caking middling coal is conveyed into the pyrolysis reactor; where the non-caking coal has a caking index of preferably less than or equal to 10 and an ash content of preferably less than or equal to 15 wt %. The mixing preferably refers to mechanical mixing; there is no special limitation on a method of the mechanical mixing, which can be conducted in a way well known to those skilled in the art.

In the present disclosure, the caking middling coal and the non-caking coal are at a mass ratio of preferably (5-9):(1-5), more preferably 5:5, 6:4, 7:3, 8:2, or 9:1.

In the present disclosure, the caking middling coal and the non-caking coal have a particle size of independently preferably 10 mm to 90 mm, more preferably 30 mm to 80 mm.

In the present disclosure, when a mixture of the caking middling coal and the non-caking coal is used as a raw material for pyrolysis, there is interactions between the caking middling coal and the non-caking coal during the pyrolysis. The non-caking coal particles block the fluidity of colloids produced by heating the caking middling coal, thus further reducing a tendency of coal particles to stick together. In addition, this mechanism can further reduce an ash content of the prepared semi-coke, strengthen mechanical properties of the semi-coke, and effectively improve a quality of semi-coke products.

In the present disclosure, the multi-channel gas distribution includes preferably: providing a first circulating carrier gas channel, a second circulating carrier gas channel, a third circulating carrier gas channel, a fourth circulating carrier gas channel, and a fifth circulating carrier gas channel in sequence from bottom to top on a side wall of the pyrolysis reactor; and introducing a circulating carrier gas into the pyrolysis reactor through the first circulating carrier gas channel, the second circulating carrier gas channel, the third circulating carrier gas channel, the fourth circulating carrier gas channel, and the fifth circulating carrier gas channel separately.

In the present disclosure, the circulating carrier gas includes preferably a waste gas produced by the zoned temperature control-based pyrolysis and a flue gas produced by mixed combustion of air. The circulating carrier gas has a temperature of preferably 750° C.

In the present disclosure, the circulating carrier gas has a carrier gas flow rate of 1,200 $m^3$/h, 200 $m^3$/h to 250 $m^3$/h, 300 $m^3$/h to 500 $m^3$/h, 200 $m^3$/h to 250 $m^3$/h, and 50 $m^3$/h to 100 $m^3$/h in the first circulating carrier gas channel, the second circulating carrier gas channel, the third circulating carrier gas channel, the fourth circulating carrier gas channel, and the fifth circulating carrier gas channel, respectively.

In the present disclosure, the drying section has a temperature of preferably less than 180° C.; the softening section has a temperature of preferably 150° C. to 395° C., more preferably 200° C. to 300° C., most preferably 230° C. to 260° C.; the melting and depolymerization section has a temperature of preferably 350° C. to 500° C., more preferably 380° C. to 430° C.; the solidification section has a temperature of preferably 500° C. to 900° C., more preferably 600° C. to 800° C.; and the cooling section has a temperature of preferably less than 80° C.

The present disclosure further provides a pyrolysis reactor, including a first circulating carrier gas channel, a second circulating carrier gas channel, a third circulating carrier gas channel, a fourth circulating carrier gas channel, and a fifth circulating carrier gas channel that are arranged in sequence from bottom to top on a side wall of the pyrolysis reactor.

In the present disclosure, the pyrolysis reactor further includes preferably a material inlet and a coal gas outlet that are arranged at a top of the pyrolysis reactor (as shown in FIGURE).

The low temperature pyrolysis method of a caking middling coal provided by the present disclosure are described in detail below with reference to the examples, but these examples may not be understood as a limitation to the protection scope of the present disclosure.

Example 1

Reaction raw materials were shown in Table 1:

TABLE 1

Physical parameters of caking middling coal and non-caking coal

| Coal material | Ash content $A_{daf}$, wt % | Volatile content $V_{daf}$, wt % | Caking index | Particle size, mm |
|---|---|---|---|---|
| Caking middling coal | 34.24 | 27.10 | 41.5 | 30-80 |
| Non-caking coal | 7.47 | 33.93 | 6.2 | 30-80 |

Pyrolysis Method (Conducted in the Pyrolysis Reactor in FIGURE):

The caking middling coal and the non-caking coal were mechanically mixed at a mass ratio of 5:5 to obtain a mixture, and the mixture had a caking index of 25.3.

The mixture was conveyed into the pyrolysis reactor through a top of the pyrolysis reactor. During the pyrolysis, a waste gas produced by zoned temperature control-based pyrolysis and a flue gas produced by mixed combustion of air were introduced into the pyrolysis reactor through the first circulating carrier gas channel, the second circulating carrier gas channel, the third circulating carrier gas channel, the fourth circulating carrier gas channel, and the fifth circulating carrier gas channel by multi-channel gas distribution, and were used as a circulating carrier gas (at 750° C.). The circulating carrier gas had a carrier gas flow rate of 1,200 $m^3$/h, 200 $m^3$/h, 300 $m^3$/h, 200 $m^3$/h, and 100 $m^3$/h in the first circulating carrier gas channel, the second circulating carrier gas channel, the third circulating carrier gas channel, the fourth circulating carrier gas channel, and the fifth circulating carrier gas channel, respectively. A reaction chamber of the pyrolysis reactor was divided into a drying section (at 165° C.), a softening section (at 371° C.), a melting and depolymerization section (at 458° C.), a solidification section (at 544° C.), and a cooling section (at 65° C.), and the zoned temperature control-based pyrolysis was conducted to obtain semi-coke (with an ash content of 27.64 ($A_d$, wt %)), and the semi-coke was discharged smoothly from a bottom of the furnace. Tar and coal gas produced by the pyrolysis were discharged from a top of the furnace by the carrier gas, and tar and gas products were obtained after separation and cooling.

Example 2

Reaction raw materials were shown in Table 1:

Pyrolysis Method (Conducted in the Pyrolysis Reactor in FIGURE):

The caking middling coal and the non-caking coal were mechanically mixed at a mass ratio of 6:4 to obtain a mixture, and the mixture had a caking index of 29.52.

The mixture was conveyed into the pyrolysis reactor through a top of the pyrolysis reactor. During the pyrolysis, a waste gas produced by zoned temperature control-based pyrolysis and a flue gas produced by mixed combustion of air were introduced into the pyrolysis reactor through the first circulating carrier gas channel, the second circulating carrier gas channel, the third circulating carrier gas channel, the fourth circulating carrier gas channel, and the fifth circulating carrier gas channel by multi-channel gas distribution, and were used as a circulating carrier gas (at 750° C.). The circulating carrier gas had a carrier gas flow rate of 1,200 $m^3$/h, 200 $m^3$/h, 350 $m^3$/h, 200 $m^3$/h, and 100 $m^3$/h in the first circulating carrier gas channel, the second circulating carrier gas channel, the third circulating carrier gas channel, the fourth circulating carrier gas channel, and the fifth circulating carrier gas channel, respectively. A reaction chamber of the pyrolysis reactor was divided into a drying section (at 158° C.), a softening section (at 374° C.), a melting and depolymerization section (at 461° C.), a solidification section (at 551° C.), and a cooling section (at 57° C.), and the zoned temperature control-based pyrolysis was conducted to obtain semi-coke (with an ash content of 29.35 ($A_d$, wt %)), and the semi-coke was discharged smoothly from a bottom of the furnace. Tar and coal gas produced by the pyrolysis were discharged from a top of the furnace by the carrier gas, and tar and gas products were obtained after separation and cooling.

Example 3

Reaction raw materials were shown in Table 1:

Pyrolysis Method (Conducted in the Pyrolysis Reactor in FIGURE):

The caking middling coal and the non-caking coal were mechanically mixed at a mass ratio of 7:3 to obtain a mixture, and the mixture had a caking index of 32.33.

The mixture was conveyed into the pyrolysis reactor through a top of the pyrolysis reactor. During the pyrolysis, a waste gas produced by zoned temperature control-based pyrolysis and a flue gas produced by mixed combustion of air were introduced into the pyrolysis reactor through the first circulating carrier gas channel, the second circulating carrier gas channel, the third circulating carrier gas channel, the fourth circulating carrier gas channel, and the fifth circulating carrier gas channel by multi-channel gas distribution, and were used as a circulating carrier gas (at 750° C.). The circulating carrier gas had a carrier gas flow rate of 1,200 $m^3$/h, 200 $m^3$/h, 400 $m^3$/h, 200 $m^3$/h, and 100 $m^3$/h in the first circulating carrier gas channel, the second circulating carrier gas channel, the third circulating carrier gas channel, the fourth circulating carrier gas channel, and the fifth circulating carrier gas channel, respectively. A reaction chamber of the pyrolysis reactor was divided into a drying section (at 156° C.), a softening section (at 372° C.), a melting and depolymerization section (at 453° C.), a solidification section (at 532° C.), and a cooling section (at 55° C.), and the zoned temperature control-based pyrolysis was conducted to obtain semi-coke (with an ash content of 33.17 ($A_d$, wt %)), and the semi-coke was discharged smoothly from a bottom of the furnace. Tar and coal gas produced by the pyrolysis were discharged from a top of the furnace by the carrier gas, and tar and gas products were obtained after separation and cooling.

Example 4

Reaction raw materials were shown in Table 1:

Pyrolysis Method (Conducted in the Pyrolysis Reactor in FIGURE):

The caking middling coal and the non-caking coal were mechanically mixed at a mass ratio of 8:2 to obtain a mixture, and the mixture had a caking index of 35.81.

The mixture was conveyed into the pyrolysis reactor through a top of the pyrolysis reactor. During the pyrolysis, a waste gas produced by zoned temperature control-based pyrolysis and a flue gas produced by mixed combustion of air were introduced into the pyrolysis reactor through the first circulating carrier gas channel, the second circulating carrier gas channel, the third circulating carrier gas channel, the fourth circulating carrier gas channel, and the fifth circulating carrier gas channel by multi-channel gas distribution, and were used as a circulating carrier gas (at 750° C.). The circulating carrier gas had a carrier gas flow rate of 1,200 $m^3$/h, 200 $m^3$/h, 450 $m^3$/h, 250 $m^3$/h, and 50 $m^3$/h in the first circulating carrier gas channel, the second circulating carrier gas channel, the third circulating carrier gas channel, the fourth circulating carrier gas channel, and the fifth circulating carrier gas channel, respectively. A reaction chamber of the pyrolysis reactor was divided into a drying section (at 167° C.), a softening section (at 395° C.), a melting and depolymerization section (at 442° C.), a solidification section (at 542° C.), and a cooling section (at 57° C.), and the zoned temperature control-based pyrolysis was conducted to obtain semi-coke (with an ash content of 35.02 ($A_d$, wt %)), and the semi-coke was discharged smoothly from a bottom of the furnace. Tar and coal gas produced by the pyrolysis were discharged from a top of the furnace by the carrier gas, and tar and gas products were obtained after separation and cooling.

Example 5

Reaction raw materials were shown in Table 1:

Pyrolysis Method (Conducted in the Pyrolysis Reactor in FIGURE):

The caking middling coal and the non-caking coal were mechanically mixed at a mass ratio of 9:1 to obtain a mixture, and the mixture had a caking index of 36.82.

The mixture was conveyed into the pyrolysis reactor through a top of the pyrolysis reactor. During the pyrolysis, a waste gas produced by zoned temperature control-based pyrolysis and a flue gas produced by mixed combustion of air were introduced into the pyrolysis reactor through the first circulating carrier gas channel, the second circulating carrier gas channel, the third circulating carrier gas channel, the fourth circulating carrier gas channel, and the fifth circulating carrier gas channel by multi-channel gas distribution, and were used as a circulating carrier gas (at 750° C.). The circulating carrier gas had a carrier gas flow rate of 1,200 $m^3$/h, 250 $m^3$/h, 500 $m^3$/h, 250 $m^3$/h, and 50 $m^3$/h in the first circulating carrier gas channel, the second circulating carrier gas channel, the third circulating carrier gas channel, the fourth circulating carrier gas channel, and the fifth circulating carrier gas channel, respectively. A reaction chamber of the pyrolysis reactor was divided into a drying section (at 163° C.), a softening section (at 368° C.), a melting and depolymerization section (at 453° C.), a solidification section (at 527° C.), and a cooling section (at 55° C.), and the zoned temperature control-based pyrolysis was conducted to obtain semi-coke (with an ash content of 35.73 ($A_d$, wt %)), and the semi-coke was discharged smoothly from a bottom of the furnace. Tar and coal gas produced by the pyrolysis were discharged from a top of the furnace by the carrier gas, and tar and gas products were obtained after separation and cooling.

Example 6

Reaction raw materials were shown in Table 2:

TABLE 2

Physical parameters of caking middling coal and non-caking coal

| Coal material | Ash content $A_{daf}$, wt % | Volatile content $V_{daf}$, wt % | Caking index | Particle size, mm |
|---|---|---|---|---|
| Caking middling coal | 27.5 | 29.61 | 32.30 | 30-80 |

Pyrolysis Method (Conducted in the Pyrolysis Reactor in FIGURE):

The caking middling coal was conveyed into the pyrolysis reactor through a top of the pyrolysis reactor. During the pyrolysis, a waste gas produced by zoned temperature control-based pyrolysis and a flue gas produced by mixed combustion of air were introduced into the pyrolysis reactor through the first circulating carrier gas channel, the second circulating carrier gas channel, the third circulating carrier gas channel, the fourth circulating carrier gas channel, and the fifth circulating carrier gas channel by multi-channel gas distribution, and were used as a circulating carrier gas (at 750° C.). The circulating carrier gas had a carrier gas flow rate of 1,200 $m^3$/h, 250 $m^3$/h, 500 $m^3$/h, 250 $m^3$/h, and 50 $m^3$/h in the first circulating carrier gas channel, the second circulating carrier gas channel, the third circulating carrier gas channel, the fourth circulating carrier gas channel, and the fifth circulating carrier gas channel, respectively. A reaction chamber of the pyrolysis reactor was divided into a drying section (at 143° C.), a softening section (at 345° C.), a melting and depolymerization section (at 447° C.), a solidification section (at 507° C.), and a cooling section (at 52° C.), and the zoned temperature control-based pyrolysis was conducted to obtain semi-coke (with an ash content of 32.25 ($A_d$, wt %)), and the semi-coke was discharged smoothly from a bottom of the furnace. Tar and coal gas produced by the pyrolysis were discharged from a top of the furnace by the carrier gas, and tar and gas products were obtained after separation and cooling.

The above are merely preferred implementations of the present disclosure. It should be noted that several improvements and modifications may further be made by a person of ordinary skill in the art without departing from the principle of the present disclosure, and such improvements and modifications should also be deemed as falling within the protection scope of the present disclosure.

What is claimed is:

1. A low temperature pyrolysis method of a caking middling coal, comprising the following steps:

mixing the caking middling coal with a non-caking coal to obtain a mixture;

conveying the mixture into a pyrolysis reactor through a top of the pyrolysis reactor;

dividing a reaction chamber of the pyrolysis reactor into a drying section, a softening section, a melting and depolymerization section, a solidification section, and a cooling section by means of multi-channel gas distribution; and conducting zoned temperature control-based pyrolysis to obtain semi-coke at a bottom of the reactor as well as tar and coal gas at the top of the reactor;

wherein the drying section has a temperature of less than 143° C.; the softening section has a temperature of 345° C.; the melting and depolymerization section has a temperature of 447° C.; the solidification section has a temperature of 507° C.; and the cooling section has a temperature of less than 52° C.;

wherein the multi-channel gas distribution comprises:

providing a first circulating carrier gas channel, a second circulating carrier gas channel, a third circulating carrier gas channel, a fourth circulating carrier gas channel, and a fifth circulating carrier gas channel in sequence from bottom to top on a side wall of the pyrolysis reactor; and introducing a circulating carrier gas into the pyrolysis reactor through the first circulating carrier gas channel, the second circulating carrier gas channel, the third circulating carrier gas channel, the fourth circulating carrier gas channel, and the fifth circulating carrier gas channel separately;

the circulating carrier gas has a carrier gas flow rate of 1,200 $m^3$/h, 250 $m^3$/h, 500 $m^3$/h, 250 $m^3$/h, and 50 $m^3$/h in the first circulating carrier gas channel, the second circulating carrier gas channel, the third circulating carrier gas channel, the fourth circulating carrier gas channel, and the fifth circulating carrier gas channel, respectively;

the non-caking coal has a caking index of 32.30, an ash content $A_{daf}$ of less than or equal to 27.5 wt %, and a volatile content $V_{daf}$ of 29.61 wt %; and the caking middling coal has a particle size of 30 mm to 80 mm.

2. The pyrolysis method according to claim 1, wherein the circulating carrier gas comprises a waste gas produced by the zoned temperature control-based pyrolysis and a flue gas produced by mixed combustion of air.

* * * * *